US005416954A

United States Patent [19]

Sobin

[11] Patent Number: 5,416,954

[45] Date of Patent: May 23, 1995

[54] FLEXIBLE FASTENER MEMBER HAVING DISTRIBUTED SPRING ACTION AREA

[75] Inventor: Donald J. Sobin, Springfield, N.J.

[73] Assignee: Nei/Do-All Corporation, Hackensack, N.J.

[21] Appl. No.: 34,368

[22] Filed: Mar. 19, 1993

[51] Int. Cl.[6] ..... A44B 1/04; A44B 11/25

[52] U.S. Cl. ..... 24/297; 411/510

[58] Field of Search ..... 24/297, 295; 411/508, 411/509, 510

[56] References Cited

U.S. PATENT DOCUMENTS

| | | | |
|---|---|---|---|
| Re. 26,898 | 5/1970 | Geldwerth . | |
| D. 300,614 | 4/1989 | Geldwerth . | |
| 393,222 | 11/1888 | Elleau . | |
| 737,064 | 8/1903 | Bigney . | |
| 856,480 | 6/1907 | Long et al. . | |
| 875,755 | 1/1908 | Warner . | |
| 1,259,544 | 3/1918 | Mergurowsky . | |
| 1,326,055 | 12/1919 | Hirsch . | |
| 1,346,736 | 6/1920 | Allee et al. . | |
| 1,393,222 | 10/1921 | Jarroll . | |
| 1,421,388 | 7/1922 | Bippart . | |
| 1,737,246 | 11/1929 | Jones . | |
| 2,952,058 | 6/1958 | Geldwerth . | |
| 3,205,546 | 9/1965 | Nelson | 24/295 |
| 3,269,145 | 2/1965 | Druskin . | |
| 3,308,517 | 3/1967 | Geldwerth . | |
| 3,350,764 | 11/1967 | Geldwerth . | |

(List continued on next page.)

FOREIGN PATENT DOCUMENTS

| | | | |
|---|---|---|---|
| 892305 | 2/1972 | Canada . | |
| 989147 | 5/1976 | Canada . | |
| 441066 | 5/1912 | France . | |
| 472684 | 8/1914 | France . | |
| 860867 | 10/1940 | France . | |
| 1193882 | 11/1959 | France | 411/509 |
| 2451175 | 10/1980 | France . | |
| 2574262 | 6/1986 | France . | |
| 213196 | 8/1908 | Germany . | |
| 261055 | 8/1912 | Germany . | |
| 64748 | 1/1913 | Switzerland . | |
| 120 | of 1900 | United Kingdom . | |
| 75 | of 1908 | United Kingdom . | |
| 12654 | of 1913 | United Kingdom . | |
| 2117038 | 10/1983 | United Kingdom . | |
| 2132680 | 7/1984 | United Kingdom . | |

OTHER PUBLICATIONS

U.S. Ser. No. 07/721,248 (pending), filed Jun. 26, 1991, to Donald John Sobin and U.S. Ser. No. 07/963,557 (pending), filed Oct. 20, 1992, which is a continuation thereof.

Derwent English-Language Abstract of French Patent No. 2,451,175 to La Dauphinoise Sappey. Mar. 1979.

Derwent English-Language Abstract of French Patent No. 2,574,262 to Société à responsabilité limitée: Bijoux Gl. Dec. 1989.

*Primary Examiner*—Edward K. Look
*Assistant Examiner*—Hoang Nguyen
*Attorney, Agent, or Firm*—Sandler Greenblum & Bernstein

[57] ABSTRACT

A flexible fastener has an apex region, a first cantilevered leg and a second cantilevered leg, joined to one another at an apex region. A distributed spring action area is positioned off of the apex region, and along at least one of the cantilevered legs, and is formed by providing the apex with a relatively thick head compared with the thickness of the leg members, so that flexure is limited to the legs, and kept away from the apex region. The flexible fastener is particularly suited for use in a catch assembly for jewelry, especially a bangle. Preferably the flexible fastener is substantially planar, and flexes within its plane of construction. Although the flexible fastener can be constructed from any material which acts as a spring, preferably the fastener is constructed from heat treatable carat gold alloy spring material.

1 Claim, 3 Drawing Sheets

U.S. PATENT DOCUMENTS 3,359,606 12/1967 Geldwerth .
3,360,836 1/1968 Geldwerth .
3,458,224 7/1969 Freese .
3,462,807 8/1969 Marquardt .
3,600,917 8/1971 Krock .
3,739,433 6/1973 Druskin .
3,947,932 4/1976 Flynn .
3,951,559 4/1976 Casey .
3,967,353 7/1976 Pagnotta et al. .
4,068,964 1/1978 Stoker .
4,150,464 4/1979 Tracy .
4,170,809 10/1979 Geldwerth et al. .
4,246,680 1/1981 Gray .
4,382,414 5/1983 Svirklys ..... 24/295 X
4,408,375 10/1983 Skobel .
4,426,854 1/1984 Geldwerth et al. .
4,480,869 11/1984 Splithoff .
4,499,634 2/1985 Zimmardi .
4,520,537 6/1985 Valikov .
4,532,682 8/1985 Muvao .
4,543,692 10/1985 Ode .
4,621,393 11/1986 Ambal .
4,667,378 5/1987 Sturm .
4,672,724 6/1987 Grotto .
4,697,315 10/1987 Geldwerth .
4,713,865 12/1987 Geldwerth .
4,715,095 12/1987 Takahashi ..... 24/297 X
4,716,633 1/1988 Rizo ..... 24/297 X
4,793,032 12/1988 Crowle .
4,813,108 3/1989 Geldwerth .
4,833,761 5/1989 Geldwerth .
4,881,305 11/1989 Rivera .
5,065,490 11/1991 Wivagg et al. ..... 24/297 X

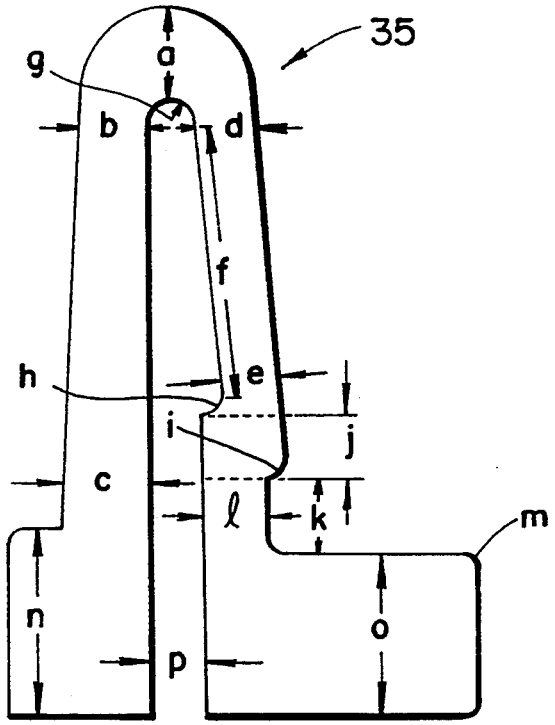
Fig- 5
Fig- 7
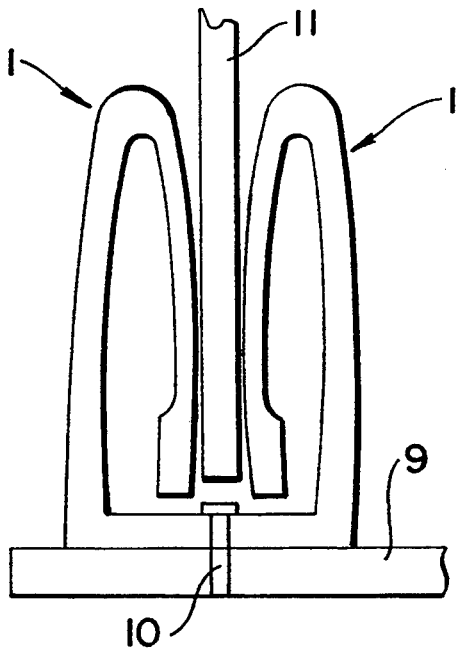
Fig- 6
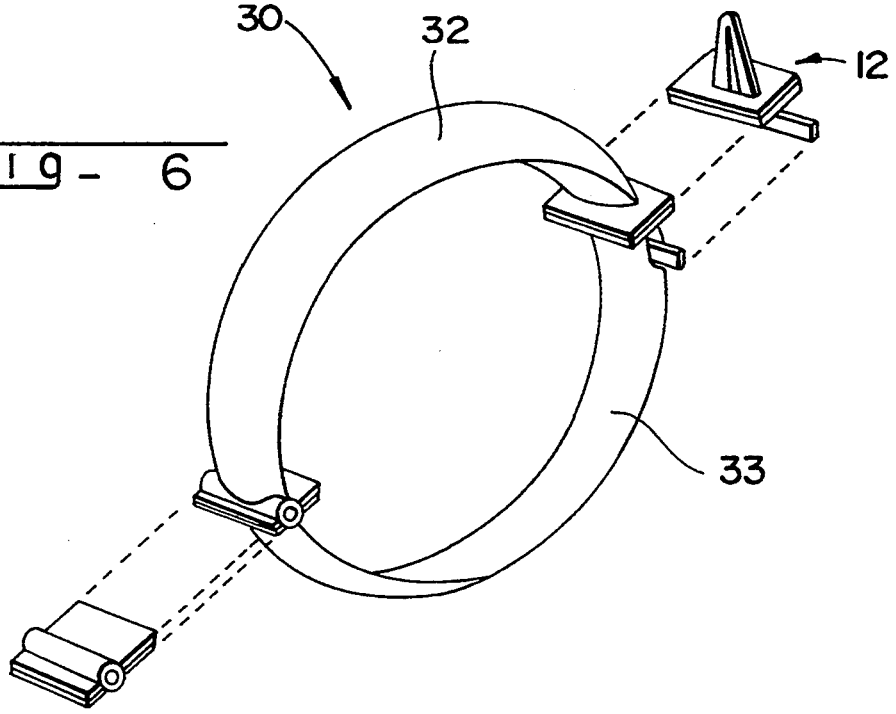

FLEXIBLE FASTENER MEMBER HAVING DISTRIBUTED SPRING ACTION AREA

BACKGROUND OF THE INVENTION

1. Field of the Invention

The present invention relates to flexible fasteners for a wide variety of uses, especially clasps for articles of jewelry such as bracelets and necklaces, to secure the jewelry to the wearer.

2. Background and Relevant Information

U.S. Pat. No. 3,350,764 ("the '764 Patent"), and its corresponding U.S. Reissue Pat. No. 26,898 ("Reissue '898") relate to a method and apparatus for attaching a clasp to a bracelet. Both the '764 Patent and Reissue '898 are hereby incorporated, in their entireties, by reference thereto. These patents disclose a bracelet clasp having a spring means for releasable locking engagement with a keeper means.

It has been discovered that spring means constructed as described in the '764 Patent tend to fracture at the apex (i.e., the leading tip) of the spring means when heated during the assembly process, e.g., during soldering of the clasp to a metal bracelet. Thus, it is desirable to construct a spring means which does not tend to fracture either when heated or during use of the article comprising the spring means. Fracture of the spring means not only has the effect of destroying the utility of the spring means, it can also result in an inability to release the engaged spring means from the keeper, necessitating damage to, or destruction of, the article onto which the spring means is installed.

Furthermore, it has been discovered that the degree of resiliency (i.e., the degree of recovery, or memory) of the spring member as disclosed in the '764 Patent is less than desired, especially when the spring member is constructed from a heat treatable carat gold alloy spring material, which, for example, is the preferred material for the construction of clasps for gold bangles (hollow gold bracelets). That is, springs made from heat treatable carat gold alloy spring material lack a desired degree of recovery, and thereby have a weaker "spring action" than is desirable. Thus, it is also desirable to increase the degree of resiliency of the spring member.

SUMMARY OF THE INVENTION

It has been discovered that the tendency of flexible spring fasteners to fracture at their apex can be alleviated by constructing a spring fastener according to the present invention, i.e. so that the flexible spring fastener has a distributed spring action area.

Furthermore, it has also been discovered that a flexible spring fastener constructed according to the present invention has an increased degree of resiliency, providing an improved initial resilience, as well as an improved degree of resilience over an extended period of use, in comparison with prior art flexible spring fasteners such as are disclosed in the '764 Patent.

The flexible fastener member of the present invention comprises a first cantilevered leg and a second cantilevered leg. The legs are joined at an apex region of the flexible fastener member. The flexible fastener member has a distributed spring action area along at least one of its cantilevered legs. The distributed spring action area is positioned off of the apex region.

Preferably, the flexible fastener member is substantially planar, and preferably flexes within this plane. Preferably, the thickness of the apex region is substantially greater than the thickness of the cantilevered legs. Preferably, the fastener member is constructed from metal or plastic, preferably, a uniform material (as opposed to different regions constructed from different materials), and still more preferably is constructed of metal, especially a heat treatable carat gold alloy spring material, such as "pintong" a hard, springy material, a substantial proportion of which is metallic gold.

The present invention also relates to a clasp in an article having opposing ends detachably securable to one another. The clasp comprises first and second metal strips transversely disposed to the article, and in face-to-face abutment with one another when the clasp is closed. Each of the strips has a slotted opening therein, and the slotted openings are aligned with one another when the clasp is closed. The clasp further comprises a flexible latch member having first and second cantilevered legs, which are joined at an apex. The first leg has a laterally offset portion affixed to a rear surface of the first transverse strip, in such a manner that the two legs are positioned for projection through the aligned slotted openings. The second leg has a second laterally offset portion projecting outwardly at one side of the article. this second offset, projection portion is provided for unlocking the latch. The second leg also has a locking recess for engagement with the second transverse strip when the clasp is closed. The locking recess has a straight margin for abutting engagement with the rear surface of the first transverse strip, in order to position the locking recess in a correct relationship with the rear surface of the second transverse strip. Finally, the latch has a distributed spring action area positioned off of the apex region, along at least one of the cantilevered legs.

While not wishing to be bound to any particular theory, it is believed that the improved degree of resiliency, as well as the alleviation of the tendency to fracture, are due to the elimination of a localized stress point (or area) at the apex region of the flexible fastener member. Flexible fastener members having an apex which is narrower than the leg members are relatively inflexible in the leg members, and tend to concentrate the spring action area at the apex region. Such a concentration of the spring action area in the apex region places a large amount of stress over a small amount of material, resulting in weakening of the material (with accompanying loss of resiliency) as well as imparting a tendency to fracture.

It has been found that the spring action area which is distributed over a substantial spring action area and kept away from the apex region of the flexible fastener member, decreases the fracture tendency and improves the springiness of the flexible fastener member. Providing an apex region less flexible than the leg members can allow the springing action (i.e, resilient flexing) to occur over a substantial portion (i.e., area) of one or more of the leg members. The apex region can be made relatively inflexible by providing it with a greater thickness than the thickness of the leg members. Likewise, a length along one or more of the leg members can be rendered more flexible than the apex region by decreasing leg thickness along the length of one or more of the leg members, without altering the thickness of the apex region. In this manner, it has been discovered that the present invention accomplishes the objectives of improved resiliency and decreased tendency to fracture during heating and use.

BRIEF DESCRIPTION OF THE DRAWINGS

The present invention is further explained in the description which follows with reference to the drawings, illustrating, by way of non-limiting examples, various embodiments of the invention, with like reference numerals representing similar parts throughout the several views, and wherein:

FIG. 5 is a cross-sectional view of a preferred flexible latch member according to the present invention, specifying various dimensions provided in the specification below.

FIG. 6 is a side elevation view of a bangle comprising a clasp according to the present invention.

FIG. 7 is a cross-sectional view of a connection using a pair of flexible fasteners according to the present invention, in conjunction with a board fastened between the pair of flexible fasteners.

DETAILED DESCRIPTION OF THE INVENTION

Figure 1:
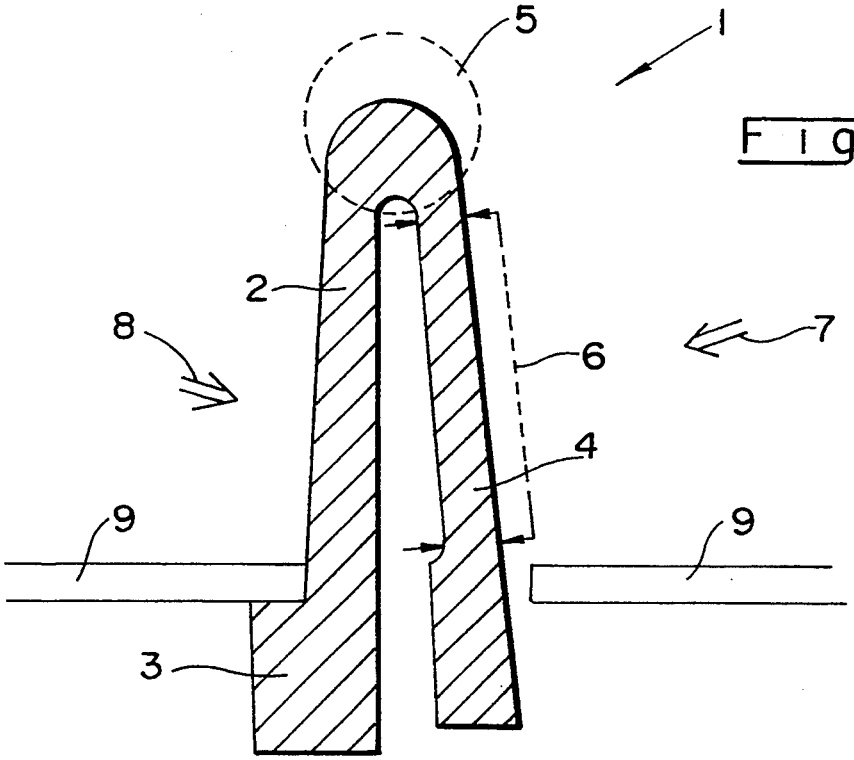
FIG. 1 is a cross-sectional view of a flexible fastener member according to the present invention.

The flexible fastener member (1) illustrated in FIG. 1 comprises a first cantilevered leg (2) optionally having a laterally offset portion (3), a second cantilevered leg (4), and an apex region (5), illustrated encircled by a dashed line). The second cantilevered leg (4) has a distributed spring action area (6) which, preferably, and as illustrated in FIG. 1, extends over the majority of the length of the second cantilevered leg (4). The entire flexible fastener member (1) is preferably constructed from a substantially uniform, resilient material suitable for use in the construction of a spring.

The flexible fastener member (1) is preferably installed by securing the first, cantilevered leg (2) to a base (9), while leaving the second cantilevered leg (4) substantially free to undergo reversible deformation in response to the application of a lateral force, i.e., force exerted in a direction as illustrated by either a single force arrow (8), or a pinching force, i.e., a combination of lateral forces represented by force arrows 8 and 7 together. The distributed spring action area (6) flexes in response to such forces. These forces flex the second cantilevered leg (4) towards the first cantilevered leg (2). Upon deformation, the resilient, springy material causes the second cantilevered leg (4) to maintain an opposing force on the object applying the deforming force.

Figure 4:
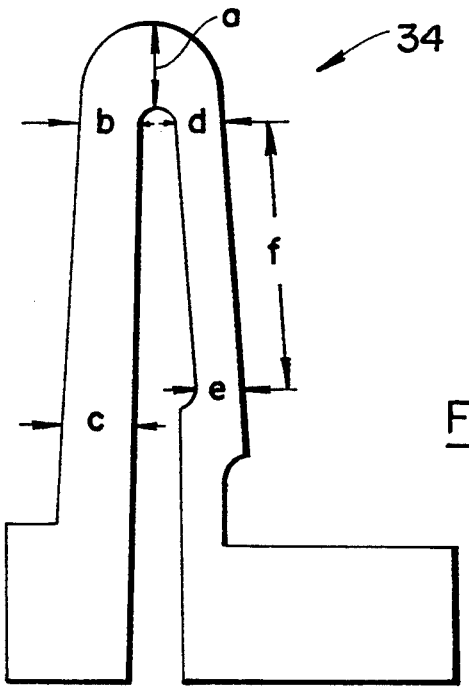
FIG. 4 is a cross-sectional view of a preferred embodiment of a flexible latch member according to the present invention, for use in a preferred clasp according to the present invention.

Notably, the apex region (5), being substantially thicker than the second cantilevered leg (4), as also shown in FIGS. 4 and 5, described below, remains substantially undeformed by the application of the forces, because the deformation (i.e., flexing) is limited to the distributed spring action area (6) of the second cantilevered leg (4). The relatively thick design of the apex region (5) prevents flexing in the apex region. The relatively thick apex region also prevents the formation of a stress point which can weaken and/or fracture the flexible fastener member (1) in the apex region (5).

Either or both of the cantilevered legs (2 and 4) can contain a distributed spring action area. However, the spring action area is positioned off of the apex region, in order to prevent the formation of a stress point in the apex region.

The distributed spring action area can be of uniform or nonuniform thickness, such as straight, curved, or irregular, so long as the spring action remains distributed over an area so that a localized stress point is not present at any point along the flexible fastener. The presence of one or more stress points can cause weakening of the spring or fracture of the flexible fastener.

For some uses, such as the jewelry clasp described in detail below, it has been found to be preferable to have the distributed spring action area (6) very slightly tapered down in thickness (i.e., of substantially uniform thickness), in the direction moving along the leg (4) and away from the apex region (5). Such a design provides the distributed spring action area described above.

The flexible fastener member (1) is suited to a wide variety of uses as an element for making a connection or fastener, which can be either reversible or irreversible. However, it is preferable to use the flexible fastener in reversible connections. More specifically, the flexible fastener can be used in clasps for jewelry, latches for containers and furniture, and even as connectors for electrical circuits, such as for the installation of plug-in electronic circuit boards. Jewelry clasps are the most preferred use of the flexible fastener of the present invention.

Figure 2:
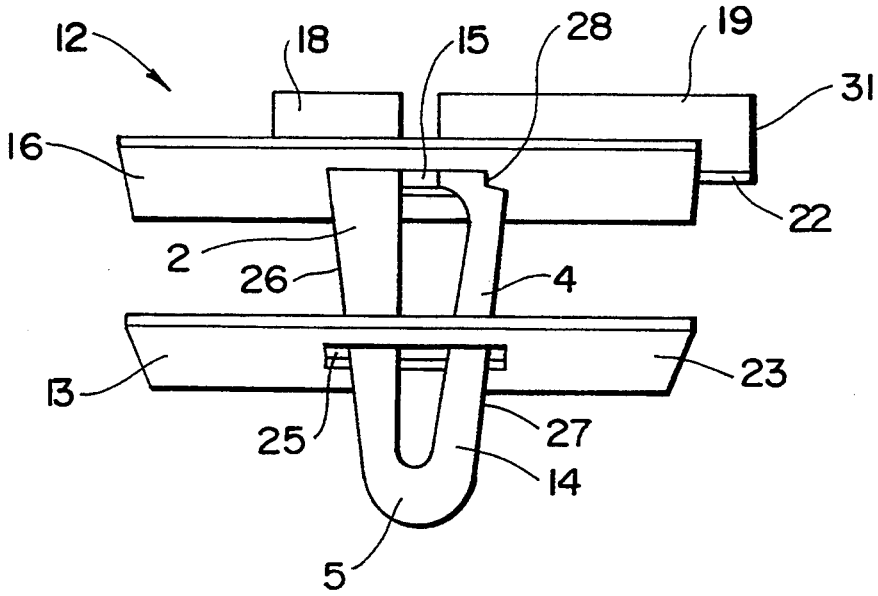
FIG. 2 is a perspective view of an unlocked clasp assembly according to the present invention, illustrated in an unlocked position and prior to attachment to an article, such as a bangle.
Figure 3:
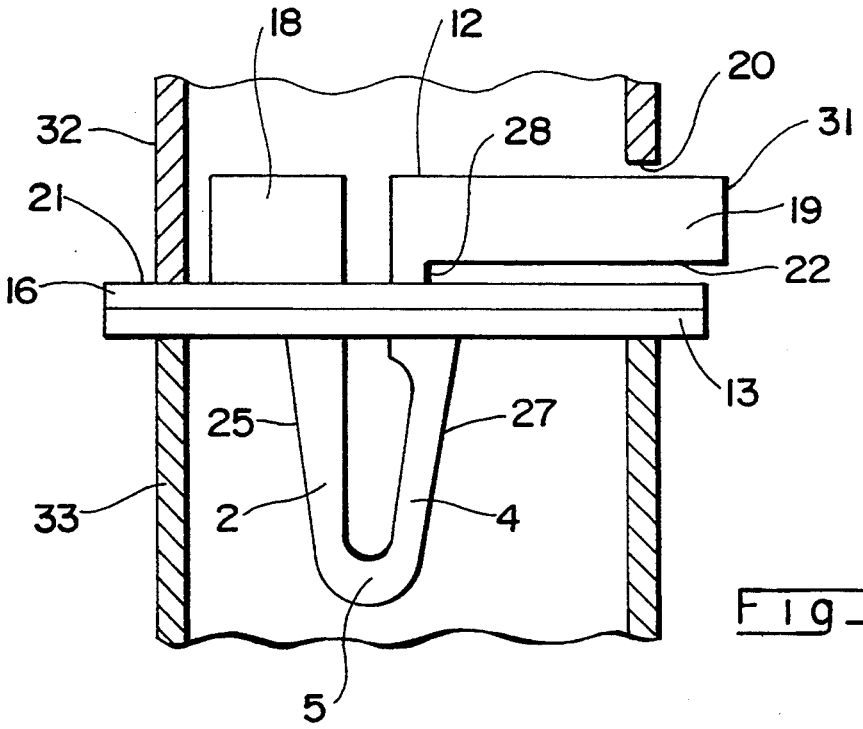
FIG. 3 is a cross-sectional view of a locked clasp assembly according to the present invention, illustrated in a locked position and attached to a hollow article, such as a bangle.

FIGS. 2 and 3 illustrate a preferred clasp assembly suitable for use in jewelry, of a type known in the trade as a single spring bangle snap, having a catch assembly (12) secured to an end of a first section (32) of a hollow bracelet (30, i.e., bangle, as shown in FIG. 6), and a keeper (13) secured to an end of a second section (33) of the hollow bracelet (30). In this type of catch there is usually provided a generally V-shaped or C-shaped flexible, resilient latch member (i.e., spring member, 14, illustrated in the preferred V-shape), shown in FIG. 2 as projecting loosely through an elongated slot (15) provided in a medial portion of a first flat strip of sheet metal (16) permanently joined transversely across an open ends the first section (32) of the hollow metal bracelet (30).

A first cantilevered leg (2) of the latch member (14) is provided with a first laterally projecting offset extension portion (18) which is permanently secured, as by soldering or welding, to a rear surface (21, see FIG. 3) of the first strip (16). The second cantilevered leg (4) of the latch member (14) is free (i.e., remains unattached to another object), and is provided with a second laterally projecting offset extension portion (19) of considerably greater length than the first extension (18). The second extension (19) projects outwardly through an opening (20) provided in the periphery of the bangle (30), and a sufficient distance so that the wearer of the bangle may compress the springy latch member (14) to unlock the clasp assembly, by pressing against an outer end (31) of the second extension (19) with the finger.

In order to prevent binding, it is desirable that there be a small amount of clearance between the rear wall (21) of the strip (16) and a forward edge (22) of the second extension (19).

The shape and dimensions of the first and second strips (16 and 23, respectively) are not critical so long as they are large enough to completely cover the ends of the bangle, the excess metal being removed after the clasp is joined to the bracelet. The second strip (23) is provided with a medially disposed slot (25) positioned generally in alignment with the opening (15), adapted to receive the forwardly projecting portion of the V-shaped latch member (14). The outer margins (26 and 27) taper outwardly away from each other in a direction towards the apex region of the latch member (14). An inwardly directed recess (28) is provided in the second cantilevered leg (4), adjacent the flat strip (16) of sheet metal.

The width of the slot (25) is such that while the apex region (5) of the latch member (14) may be initially inserted therein without compression of the latch member, further insertion of the latch member causes the free second cantilevered leg (4) to compress towards the fixed first cantilevered leg (2) until the second strip (23) engages the locking recess (28) at which point the free second cantilevered leg (4) springs outwardly to position a ledge (29) of the recess (28) behind the strip (23). The length of the recess (28) should be such that the two strips (16 and 23) are maintained in substantially abutting relationship when the clasp is locked, arid the width of the slit (15) in the first strip (16) is such that there is a slight amount of clearance between the first strip (16) and the free second cantilevered leg (4) .

FIG. 3 illustrates the clasp assembly is a locked position. The clasp is unlocked by exerting pressure against the end of the second extension (19) to flex the free second cantilevered leg (4) to allow the recess (28) to clear the slot (25) in the keeper (13).

In FIG. 4, various locations of a preferred latch member (34) are now provided. The thickness (a) at the apex is 0.064 inch. The thickness (b) at a point near the upper end of the first cantilevered leg (2) is 0.043 inch. The thickness (c) at a point near the lower end of the first cantilevered leg (2) is 0.056 inch. The thickness (d) at a point near the upper end of the second cantilevered leg (4) is 0.041 inch. The thickness (e) at a point near the lower end of the second cantilevered leg (4) is 0.039 inch. The length of the distributed spring action area (f) is 0.195 inch. The depth (into the drawing) of the preferred latch member (34) illustrated in FIG. 4 is about 0.028 inches.

FIG. 5 illustrates a preferred embodiment of a latch member (35) according to the invention, for use in the clasp of the present invention, and designates the various dimensions discussed immediately above, as well as additional measurements of various thicknesses, lengths, and radii of curvature of various portions, as follows:

(a) through (f) are identical to the dimensions provided in FIG. 4;

(g) is a radius of curvature of 0.017 inch;

(h) is a radius of curvature of 0.009 inch;

(i) is a radius of curvature of 0.008 inch;

(j) is a length of 0.040 inch;

(k) is a length of 0.054 inch;

(l) is a thickness of 0.040 inch;

(m) is a radius of curvature of 0.004 inch;

(n) is a length of 0.119 inch;

(o) is a length of 0.102 inch; and (p) is a gap width of 0.035 inch.

In FIG. 5, as for the measurements provided for FIG. 4, the units of all the dimensions of the various lengths, thicknesses, and radii of curvature have been set forth in inches.

The most preferred material for use in making the flexible fastener member and clasp of the present invention is a heat treatable carat gold alloy spring material, such as a material commonly referred to as "pintong". This material is a very hard, springy alloy containing, for example, 10 carat gold or 14 carat gold. Such materials can be obtained from, for example, Liberty Plate & Wire Inc., of 2478 McDonald Avenue, Brooklyn, N.Y., 11223.

A bangle (30), having two hollow, curved, bracelet sections (31 and 32), is illustrated in FIG. 6. The bracelet sections (31 and 32) are fastened to one another via a hinge assembly (33) and the catch assembly (12) described in detail above. FIG. 6 illustrates the bangle in its closed, latched position.

FIG. 7 illustrates an alternative use for the flexible fastener member of the present; invention. In FIG. 7, a pair of joined flexible fastener members (1) mounted on a base (9) by a rivet (10). A pin (11) projecting from, for example, an electronic circuit board (not illustrated), is forced between the flexible fastener members (1), causing the deformation of the distributed spring action areas on each of the flexible fastener members (1), with the result that the pin (11) is securely but reversibly connected to the base (9) by the fastener members (1). FIG. 8 also illustrates the distributed spring action areas in the "flexed" position, due to the application of force. As in FIG. 1, the relatively greater thickness of the apex regions relative to the distributed spring action areas (6), produces no substantial deformation of the apex regions, thereby preventing weakening or fracture of the apex regions.

The method of securing the clasp assembly to the bangle (31 and 32) is preferably as described in the '764 Patent and Reissue '898. In FIGS. 2 and 3, the first strip (16) and the latch member (14) are illustrated as coated in a manner to prevent solder or welding material from flowing thereon and sealing the clasp assembly into the locked position.

Finally, although the invention has been described with reference to particular means, materials and embodiments, it should be noted that the invention is not limited to the particulars disclosed, and extends to all equivalents within the scope of the claims.

What is claimed is:

1. A clasp in an article having opposing ends detachably securable to one another, comprising:

a first flat strip of metal and a second flat strip of metal, transversely disposed to said article and being in face-to-face abutment to one another when the clasp is closed, each of said strips having a slotted opening therein, said slotted openings being aligned with one another when said clasp is closed;

a substantially planar, flexible latch member which is flexible within a plane, said latch member comprising a first cantilevered leg and a second cantilevered leg, said legs being joined at an apex region, said first leg having a laterally offset portion affixed to a rear surface of said first transversely disposed flat strip of metal, in order to position the two legs for projection through said aligned slotted openings, said second leg having a second laterally projecting offset extension portion to project outwardly at one side of said article, for unlocking said latch, said second leg also having a locking recess for engagement with said second flat strip when said clasp is closed, said locking recess having a straight margin for abutting engagement with said rear surface of said first transversely disposed flat strip to position said locking recess in a correct relationship to the rear surface of said second transversely disposed abutting strips, said apex region being substantially thicker than said cantilevered legs, so that a spring action area is distributed off of said apex region along at least one of said cantilevered legs;

said latch member has a thickness of about 0.028 inch;

said apex has a thickness of about 0.064 inch;

said first cantilevered leg has a thickness at a point near an upper end of about 0.043 inch, and a thickness at a point near a lower end of about 0.056 inch;

said second cantilevered leg has a thickness at a point near an upper end of about 0.041 inch, and a thickness at a point near a lower end of about 0.039 inch; and said distributed spring action area on said second cantilevered leg has a length of about 0.195 inch.

* * * * *

UNITED STATES PATENT AND TRADEMARK OFFICE

CERTIFICATE OF CORRECTION

PATENT NO. : 5,416,954
DATED : May 23, 1995
INVENTOR(S) : Donald J. SOBIN

It is certified that error appears in the above-indentified patent and that said Letters Patent is hereby corrected as shown below:

On the cover, in section [56], "References Cited", "FOREIGN PATENT DOCUMENTS", line 12, change "of 1900" to ---2/1900---.

On the cover, in section [56], "References Cited", "FOREIGN PATENT DOCUMENTS", line 13, change "of 1908" to ---5/1908---.

On the cover, in section [56], "References Cited", "FOREIGN PATENT DOCUMENTS", line 14, change "of 1913" to ---10/1913---.

On the cover, in section [56], "References Cited", "FOREIGN PATENT DOCUMENTS", line 15, change "2117038" to ---2117038A---.

On the cover, in section [56], "References Cited", "FOREIGN PATENT DOCUMENTS", line 16, change "2132680" to ---2132680A---.

At column 3, line 48, change "first," to ---first---.

At column 5, line 26, change "arid" to ---and---.

Signed and Sealed this

Twenty-second Day of October, 1996

*Attest:*

*Attesting Officer*

Bruce Lehman

BRUCE LEHMAN

*Commissioner of Patents and Trademarks*